US010900361B2

(12) United States Patent
Marsh et al.

(10) Patent No.: US 10,900,361 B2
(45) Date of Patent: Jan. 26, 2021

(54) TURBINE AIRFOIL WITH BIASED TRAILING EDGE COOLING ARRANGEMENT

(71) Applicants: MIKRO SYSTEMS, INC., Charottesville, VA (US); SIEMENS ENERGY, INC., Orlando, FL (US)

(72) Inventors: Jan H. Marsh, Orlando, FL (US); Matthew J. Golsen, Deltona, FL (US); Daniel Joo, Orlando, FL (US)

( * ) Notice: Subject to any disclaimer, the term of this patent is extended or adjusted under 35 U.S.C. 154(b) by 200 days.

(21) Appl. No.: 15/997,287

(22) Filed: Jun. 4, 2018

(65) Prior Publication Data

US 2018/0283184 A1 Oct. 4, 2018

Related U.S. Application Data

(63) Continuation of application No. PCT/US2015/064006, filed on Dec. 4, 2015.

(51) Int. Cl.

*F01D 5/18* (2006.01)
*F01D 9/04* (2006.01)
*F01D 25/12* (2006.01)

(52) U.S. Cl.

CPC ..... *F01D 5/187* (2013.01); *F01D 9/041* (2013.01); *F01D 25/12* (2013.01);
(Continued)

(58) Field of Classification Search

CPC ..... F01D 5/187; F01D 25/12; F01D 9/041; F05D 2250/16; F05D 2240/304;
(Continued)

(56) References Cited

U.S. PATENT DOCUMENTS 4,278,400 A 7/1981 Yamarik et al.
4,752,186 A * 6/1988 Liang ..... F01D 5/187 416/97 R
(Continued)

FOREIGN PATENT DOCUMENTS

EP 1431514 A2 6/2004
EP 1467065 A2 10/2004
(Continued)

OTHER PUBLICATIONS

International Search Report for Application No. PCT/US2015/064006.
Written Opinion for Application No. PCT/US2015/064006.

*Primary Examiner* — J. Todd Newton
(74) *Attorney, Agent, or Firm* — Cantor Colburn LLP

(57) ABSTRACT

An airfoil for a turbine engine includes an array of features positioned in an interior portion of the airfoil. Each feature extends from a pressure side to a suction side. The array includes multiple radial rows (A-N) of features with the features in each row (A-N) being interspaced radially to define coolant passages therebetween. The radial rows (A-N) are spaced along a forward-to-aft direction toward an airfoil trailing edge. The coolant passages of the array are fluidically interconnected to lead a pressurized coolant toward the trailing edge via a serial impingement on to the rows of features. The coolant passages are geometrically configured to bias a coolant flow therethrough toward a first side in relation to a second side of the outer wall to effect a greater cooling of the first side than the second side.

12 Claims, 5 Drawing Sheets

(52) U.S. Cl.
CPC ..... *F05D 2210/40* (2013.01); *F05D 2220/32* (2013.01); *F05D 2240/304* (2013.01); *F05D 2250/14* (2013.01); *F05D 2250/16* (2013.01); *F05D 2250/22* (2013.01); *F05D 2250/23* (2013.01); *F05D 2260/201* (2013.01); *F05D 2260/2214* (2013.01)

(58) Field of Classification Search
CPC ..... F05D 2250/22; F05D 2250/14; F05D 2250/23; F05D 2260/2214; F05D 2260/201; F05D 2220/32
USPC ..... 416/96 R
See application file for complete search history.

(56) References Cited

U.S. PATENT DOCUMENTS 6,000,466 A * 12/1999 Aoyagi ..... F28F 1/40 165/133
6,227,804 B1 * 5/2001 Koga ..... F01D 5/187 415/115
6,234,754 B1 * 5/2001 Zelesky ..... F01D 5/187 415/115
6,607,355 B2 * 8/2003 Cunha ..... F01D 5/18 416/97 R
6,939,107 B2 9/2005 Mongillo, Jr. et al.
6,984,102 B2 * 1/2006 Bunker ..... F01D 5/187 415/115
7,186,084 B2 * 3/2007 Bunker ..... F01D 5/187 416/96 R
7,484,928 B2 * 2/2009 Arness ..... B23K 9/0026 415/115
7,575,414 B2 * 8/2009 Lee ..... F01D 5/186 415/115
7,938,624 B2 * 5/2011 Tibbott ..... F01D 5/187 415/115
8,714,909 B2 * 5/2014 Propheter-Hinckley ..... F01D 11/24 415/115
9,957,816 B2 * 5/2018 Bunker ..... F02C 7/18
10,247,099 B2 * 4/2019 Quach ..... F01D 5/187
10,436,048 B2 * 10/2019 Brzek ..... F01D 9/065
10,557,354 B2 * 2/2020 Otero ..... F01D 5/185
2001/0012484 A1 * 8/2001 Beeck ..... B22D 11/0405 416/97 R
2008/0063524 A1 3/2008 Tibbott
2009/0145581 A1 * 6/2009 Hoffman ..... F28F 1/40 165/80.3
2010/0183429 A1 7/2010 Liang
2011/0135446 A1 * 6/2011 Dube ..... B22C 9/04 415/115
2011/0176930 A1 * 7/2011 Ahmad ..... F01D 5/187 416/97 R
2013/0089434 A1 * 4/2013 Simpson ..... F01D 5/187 416/97 R
2013/0280092 A1 * 10/2013 Xu ..... F01D 5/187 416/97 R
2015/0345305 A1 * 12/2015 Allen ..... F01D 5/188 416/95
2018/0363468 A1 * 12/2018 Beyer ..... F01D 5/141
2019/0271232 A1 * 9/2019 Thorton ..... F01D 5/189

FOREIGN PATENT DOCUMENTS

EP 1548230 A2 6/2005
EP 1918522 A2 5/2008
EP 2628901 A1 8/2013
EP 2942485 A1 * 11/2015 ..... F01D 5/284
WO 2013120552 A1 8/2013
WO 2015088821 A1 6/2015
WO WO-2015088821 A1 * 6/2015 ..... F01D 5/187
WO WO-2018136042 A1 * 7/2018 ..... F01D 5/187

* cited by examiner

VIEW II-II

VIEW U-U

VIEW V-V

VIEW X-X

VIEW Y-Y

TURBINE AIRFOIL WITH BIASED TRAILING EDGE COOLING ARRANGEMENT

CROSS REFERENCE TO RELATED APPLICATIONS

This application is a continuation of PCT Application No. PCT/US2015/064006 filed on Dec. 4, 2015, the contents each of which are incorporated herein by reference thereto.

BACKGROUND

1. Field

This invention relates generally to an airfoil in a turbine engine, and in particular, to a trailing edge cooling arrangement for a turbine airfoil.

2. Description of the Related Art

In gas turbine engines, compressed air discharged from a compressor section and fuel introduced from a source of fuel are mixed together and burned in a combustion section, creating combustion products defining a high temperature working gas. The working gas is directed through a hot gas path in a turbine section of the engine, where the working gas expands to provide rotation of a turbine rotor. The turbine rotor may be linked to an axial shaft to power the upstream compressor and an electric generator, wherein the rotation of the turbine rotor can be used to produce electricity in the generator.

In view of high pressure ratios and high engine firing temperatures implemented in modern engines, certain components, such as airfoils, e.g., stationary vanes and rotating blades within the turbine section, must be cooled with cooling fluid, such as air discharged from a compressor in the compressor section, to prevent overheating of the components.

Effective cooling of turbine airfoils requires delivering the relatively cool air to critical regions such as along the trailing edge of a turbine blade or a stationary vane. The associated cooling apertures may, for example, extend between an upstream, relatively high pressure cavity within the airfoil and one of the exterior surfaces of the airfoil. Airfoil cavities typically extend in a radial direction with respect to the rotor and stator of the machine.

Airfoils commonly include internal cooling channels which remove heat from the pressure sidewall and the suction sidewall in order to minimize thermal stresses. Achieving a high cooling efficiency based on the rate of heat transfer is a significant design consideration in order to minimize the volume of coolant air diverted from the compressor for cooling.

SUMMARY

Briefly, aspects of the present invention provide an improved trailing edge cooling arrangement for a turbine airfoil.

According to a first aspect of the invention, an airfoil for a turbine engine is provided, which includes an outer wall formed by a pressure side and a suction side extending span-wise along a radial direction and joined at a leading edge and at a trailing edge. An array of features is positioned in an interior portion of the airfoil. Each feature extends from the pressure side to the suction side. The array comprises multiple radial rows of said features with the features in each row being interspaced radially to define coolant passages therebetween. The radial rows are spaced along a forward-to-aft direction toward the trailing edge. The coolant passages of the array are fluidically interconnected to lead a pressurized coolant toward the trailing edge via a serial impingement on to said rows of features. The coolant passages are geometrically configured to bias a coolant flow therethrough toward a first side in relation to a second side of the outer wall, to effect a greater cooling of the first side than the second side.

According to a second aspect of the invention, an airfoil for a turbine engine comprises an outer wall delimiting an airfoil interior and being formed by a pressure side and a suction side extending span-wise along a radial direction and joined at a leading edge and at a trailing edge. A chordal direction may be defined extending from the leading edge to the trailing edge. An array of features is positioned in the airfoil interior. Each feature extends from the pressure side to the suction side. The array comprises multiple radial rows of said features with the features in each row being interspaced radially to define coolant passages therebetween. The radial rows are spaced along the chordal direction. The coolant passages of the array are fluidically interconnected to lead a pressurized coolant from a coolant cavity chordally upstream of said array toward a plurality of exhaust openings at the trailing edge. The coolant passages are geometrically configured such that coolant ejected through the coolant passages has a higher local velocity along the pressure side than along the suction side to effect a greater convective cooling at the pressure side than the suction side.

According to a third aspect of the invention, an airfoil for a turbine engine comprises an outer wall delimiting an airfoil interior and being formed by a pressure side and a suction side extending span-wise along a radial direction and joined at a leading edge and at a trailing edge. A chordal direction may be defined extending from the leading edge to the trailing edge. An array of features is positioned in the airfoil interior. Each feature extends from the pressure side to the suction side. The array comprises multiple radial rows of said features with the features in each row being interspaced radially to define coolant passages therebetween. The radial rows being spaced along the chordal direction. The coolant passages of the array are fluidically interconnected to lead a pressurized coolant from a coolant cavity chordally upstream of said array toward a plurality of exhaust openings at the trailing edge, via a series of impingements on to said rows of features. The features of chordally adjacent rows are staggered in the radial direction such that coolant ejected from a coolant passage in a particular row impinges on an impingement surface of a feature in a chordally adjacent row. The coolant passage has a flow cross-section geometrically configured such that a distribution of coolant jet impinging upon the impingement surface is higher toward the pressure side than the suction side to effect a greater impingement cooling at the pressure side than the suction side.

BRIEF DESCRIPTION OF THE DRAWINGS

The invention is shown in more detail by help of figures. The figures show specific configurations and do not limit the scope of the invention.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

The present inventors have recognized certain technical problems in connection with existing trailing edge cooling arrangements. In particular, it has been seen that during operation, there is an uneven heating of the airfoil outer wall exposed to the hot gas path, with the pressure side of the airfoil outer wall often being at a significantly higher temperature than the suction side. A difference in metal temperatures between the two sides of the airfoil outer wall may lead to uneven thermal expansion rates which may induce unnecessary thermal stresses or may even deform the shape of the airfoil during start-up and operation. Embodiments of the present invention illustrated herein attempt to balance the external differences in temperatures in the outer wall by shaping an internal coolant flow so that the coolant flow is biased toward one of the pressure side or suction side depending upon which is at a higher temperature, to effect a greater overall cooling thereof in relation to the other side. A skewed cooling of the outer wall may be thereby achieved without the need to structurally modify the airfoil outer wall (for e.g. by varying the thickness between the pressure side and suction side, etc.). In particular, specific embodiments of the invention may be used for biasing convective and/or impingement cooling toward the pressure side near the trailing edge.

Figure 1:
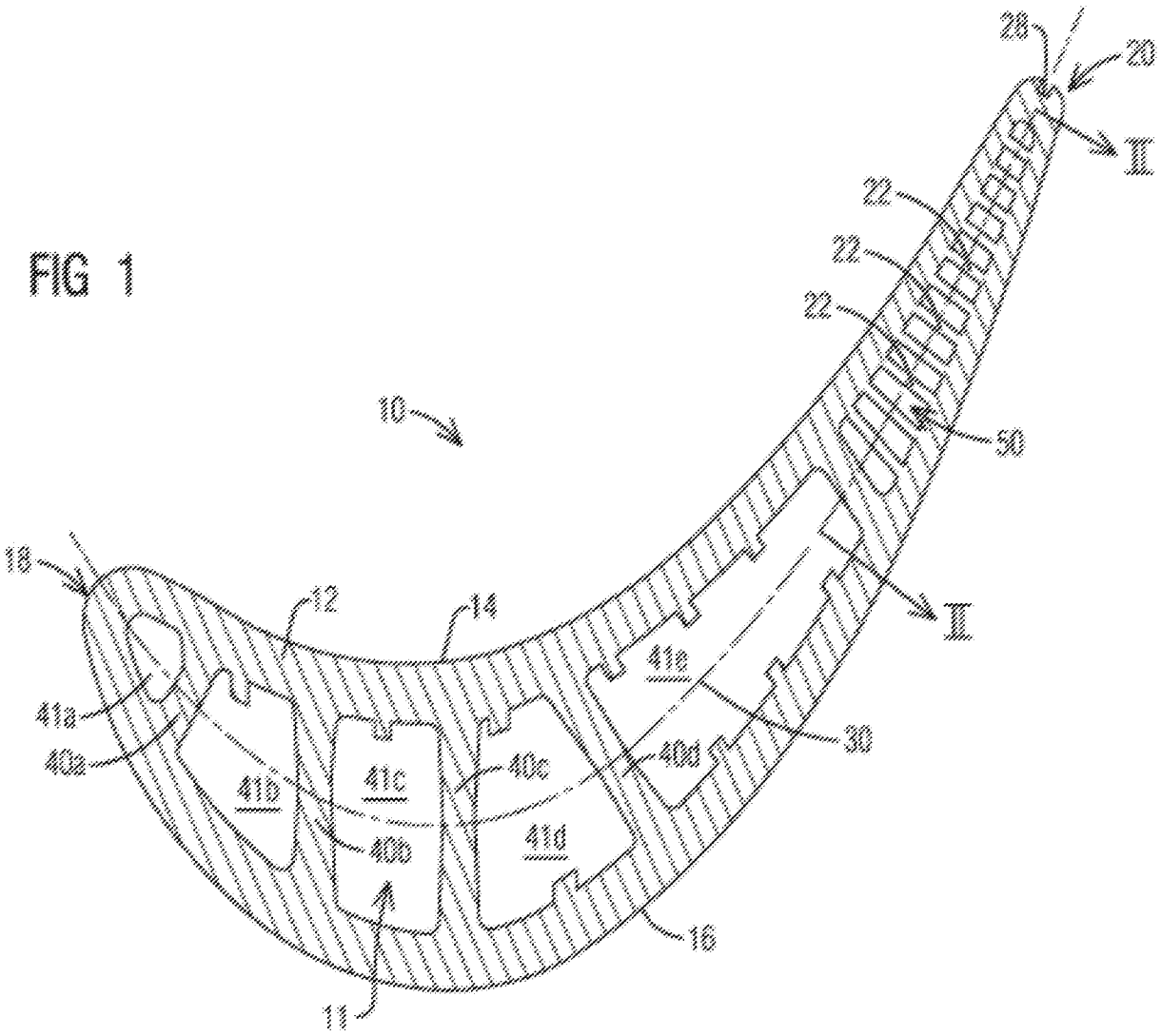
FIG. 1 is a cross-sectional view of a turbine airfoil including a trailing edge cooling arrangement in accordance with an embodiment of the present invention.

Referring to FIG. 1, a turbine airfoil 10 may comprise an outer wall 12 delimiting a generally hollow airfoil interior 11. The outer wall 12 extends span-wise in a radial direction of the turbine engine, which is perpendicular to the plane of FIG. 1. The outer wall 12 is formed by a generally concave sidewall defining a pressure side 14 and a generally convex sidewall defining a suction side 16. The pressure side 14 and the suction side 16 are joined at a leading edge 18 and at a trailing edge 20. A chordal direction 30 may be defined as extending centrally between the pressure side 14 and the suction side 16 from the leading edge 18 to the trailing edge 20. In this description, the relative term "forward" refers to a direction from the trailing edge 20 toward the leading edge 18, while the relative term "aft" refers to a direction from the leading edge 18 toward the trailing edge 20. As shown, internal passages and cooling circuits are formed by radial cavities 41*a-e* that are created by internal partition walls or ribs 40*a-d* which connect the pressure and suction sides 14 and 16.

As illustrated, the airfoil 10 is a turbine blade for a gas turbine engine. It should however be noted that aspects of the invention could additionally be incorporated into stationary vanes in a gas turbine engine. In the present example, coolant may enter one or more of the radial cavities 41*a-e* via openings provided in the root of the blade 10. For example, coolant may enter the radial cavity 41*e* via an opening in the root and travel radially outward to feed into forward and aft cooling branches. In the forward cooling branch, the coolant may traverse a serpentine cooling circuit toward a mid-chord portion of the airfoil 10 (not illustrated in any further detail). In the aft cooling branch, the coolant may traverse axially (forward-to-aft) through an internal arrangement of a trailing edge cooling arrangement 50, positioned aft of the radial cavity 41*e*, before leaving the airfoil 10 via a plurality of exhaust openings 28 arranged along the trailing edge 20.

Figure 2:
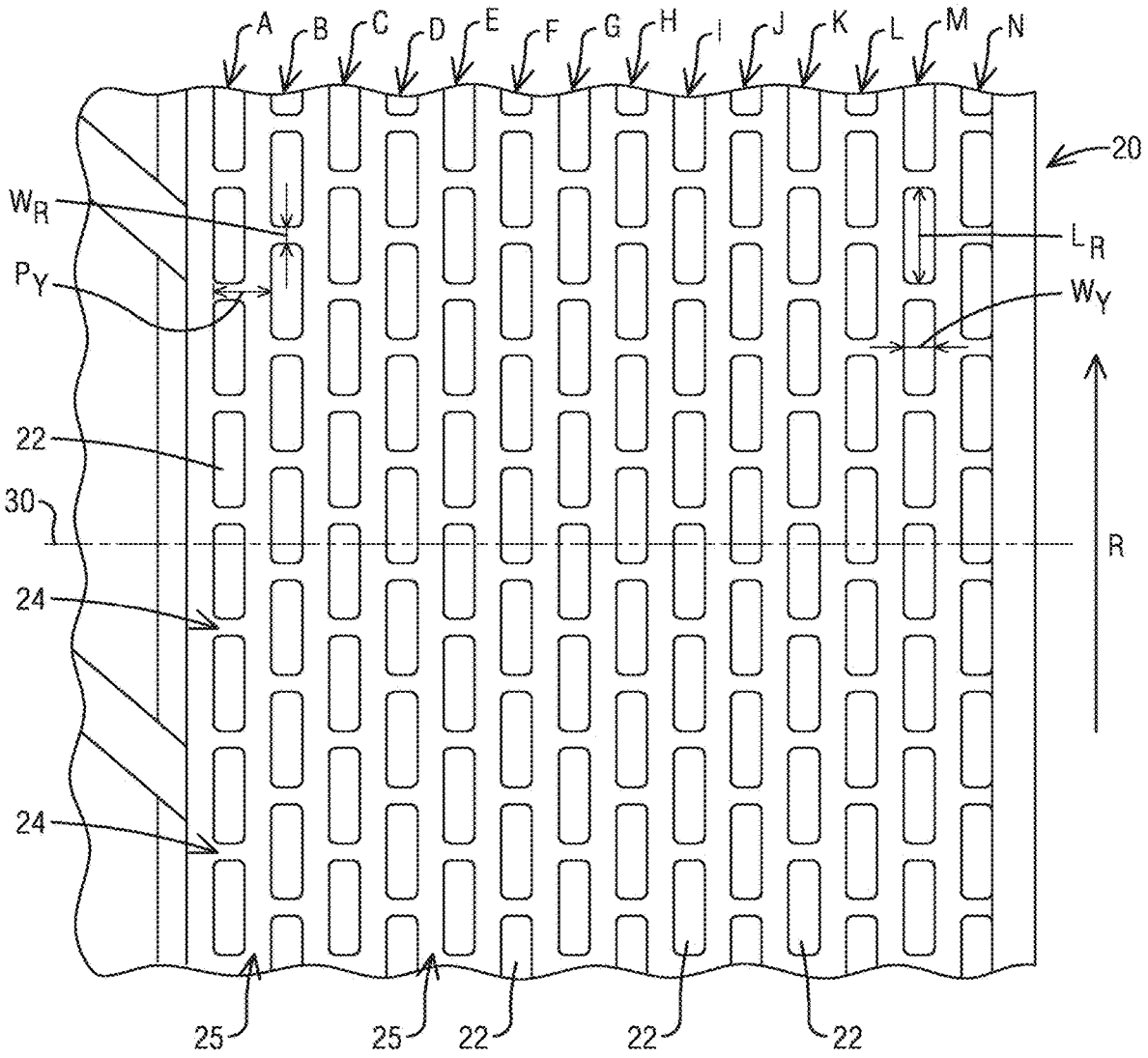
FIG. 2 is a sectional view along the section II-II of FIG. 1, showing an array of features according to the illustrated embodiment.

As shown in FIG. 2, the trailing edge cooling arrangement 50 of the illustrated embodiment comprises an array of features 22, which may be embodied, for example as pins, positioned in the airfoil interior 11. Each feature 22 extends from the pressure side 14 to the suction side 16 (see FIG. 1). The array includes a number of radial rows of features 22 (in this case, fourteen), serially designated A through N, that are spaced along the chordal direction 30, forward-to-aft. Radial flow passages 25 are defined at the interspaces between adjacent rows of features 22. The features 22 in each of the rows A through N are interspaced radially to define axial coolant passages 24 therebetween that have a flow axis along the chordal direction 30 (forward-to-aft). The axial coolant passages each extend from the pressure side 14 to the suction side 16. The axial coolant passages 24 of the array are fiuidically interconnected via the radial flow passages 25, to lead a pressurized coolant from the coolant cavity 41*e* toward the exhaust openings 28 at the trailing edge 20 (see FIG. 1) via a serial impingement scheme. In particular, the pressurized coolant flowing generally forward-to-aft impinges serially on to the rows of features 22, leading to a transfer of heat to the coolant accompanied by a drop in pressure of the coolant. Heat may be transferred from the outer wall 12 to the coolant by way of convection and/or impingement cooling, usually a combination of both. In convection cooling, heat from the pressure and suction sides 14 and 16 is transferred to the coolant as a function of the flow velocity of the coolant and the heat transfer surface along the pressure and suctions sides 14 and 16. In impingement cooling, heat from the features 22 is transferred to the coolant upon impingement, and the pressure and suction sides 14 and 16 are resultantly cooled by heat conduction through the features 22.

In the illustrated embodiment, each feature 22 is elongated along the radial direction R. That is to say, each feature 22 has a length LR in the radial direction R which is greater than a width Wy in the stream-wise or chordal direction 30. A higher aspect ratio (LR/WY) provides a longer flow path for the coolant in the passages 25, leading to increased cooling surface area and thereby higher convective heat transfer. Furthermore, the array may be geometrically configured for enhancing coolant pressure drop. For example, in one non-limiting embodiment, the length LR of each feature may be greater than a stream-wise pitch or periodicity Pγ of the array. The above features individually and in combination improve cooling efficiency and reduce coolant flow requirement, whereby turbine efficiency may be improved. In the shown embodiment, the features 22 are rectangular in shape, when viewed in a direction from the pressure side 14 to the suction side 16. To reduce stress concentration, the corners of the rectangle may be rounded or filleted. However, the illustrated shape of the features 22 is non limiting and other geometries may be used, including but not limited to a crown shape, a double chevron shape, or an elliptical, oval or circular shape, as viewed in a direction from the pressure side 14 to the suction side 16.

Figure 3A:
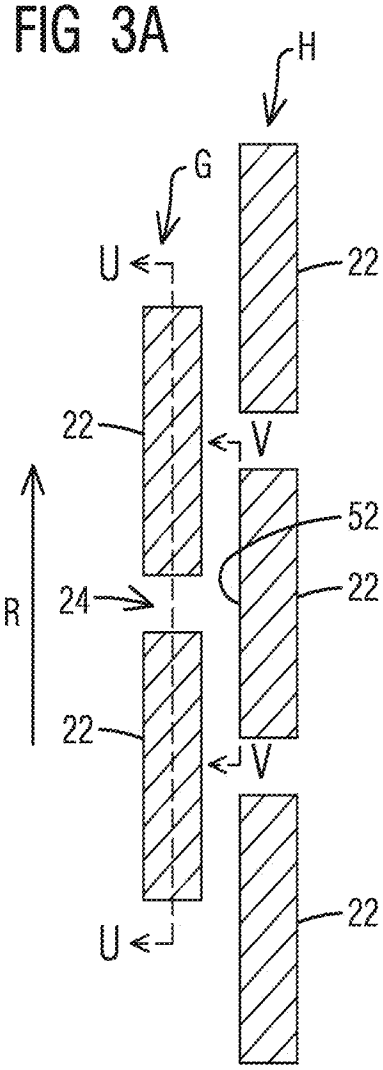
FIG. 3A illustrates an enlarged schematic view of a pair of adjacent rows of features looking in a direction from a pressure side to a suction side of an airfoil as per a first configuration.
Figure 3B:
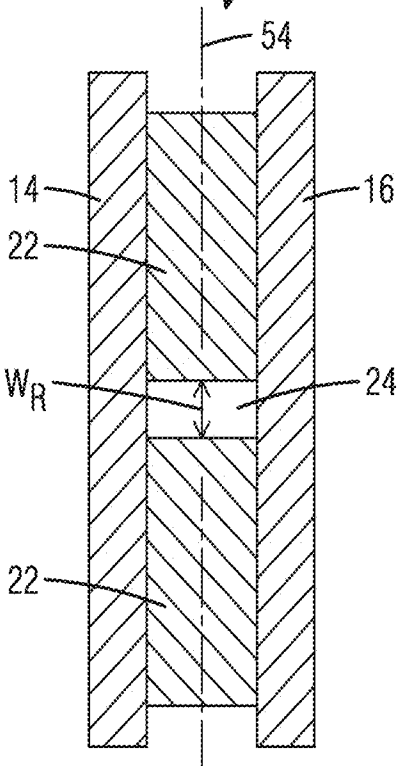
FIG. 3B illustrates a schematic sectional view along the section U-U of FIG. 3 A looking forward-to-aft, illustrating a flow cross-section of a coolant passage according to the first configuration.
Figure 3C:
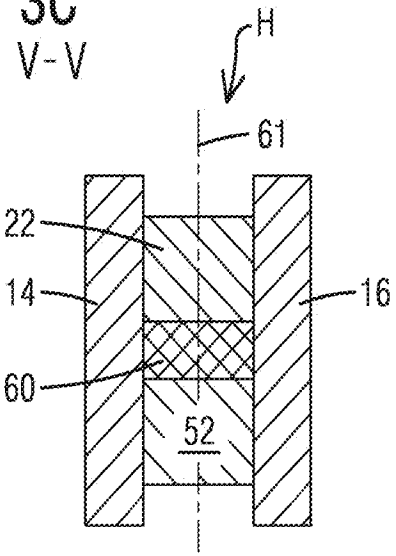
FIG. 3C illustrates a schematic sectional view along the section V-V of FIG. 3 A looking forward-to-aft, illustrating an impingement region according to the first configuration.

FIG. 3A illustrates an enlarged schematic view of a pair of adjacent rows of features looking in a direction from the pressure side 14 to the suction side 16 in accordance with a first configuration. As shown, the features 22 of adjacent rows are staggered in the radial direction R such that coolant ejected from a coolant passage 24 in a particular row, e.g., row G, impinges on an impingement surface 52 of a feature 22 in an adjacent row, i.e., row H. Referring to FIG. 3B, in the first configuration, the coolant passage 24 extends from the pressure side 14 to the suction side 16 and has a rectangular flow cross-section symmetrical about a radial centerline 54 between the pressure side 14 and the suction side 16. The symmetrical flow cross-section between the pressure and suction sides 14 and 16 creates a substantially symmetrical mass flow distribution and velocity profile of the coolant about the centerline 54, leading to approximately equal convective heat transfer coefficients along the pressure side 14 and the suction side 16. Moreover, as shown in FIG. 3C, the symmetrical flow cross-section may also lead to a substantially symmetrical distribution of the coolant jet 60 on the impingement surface 52 on the feature 22 at the adjacent row H, thereby leading to approximately equal amounts of heat removed by impingement cooling from the pressure side 14 and the suction side 16. The configuration shown in FIGS. 3A-C, while providing increased overall heat transfer, may not sufficiently address the difference in temperature at the outer wall 12 between the pressure side 14 and the suction side 16, which may, for example, be 200° C. or even higher in certain cases.

Figure 4A:
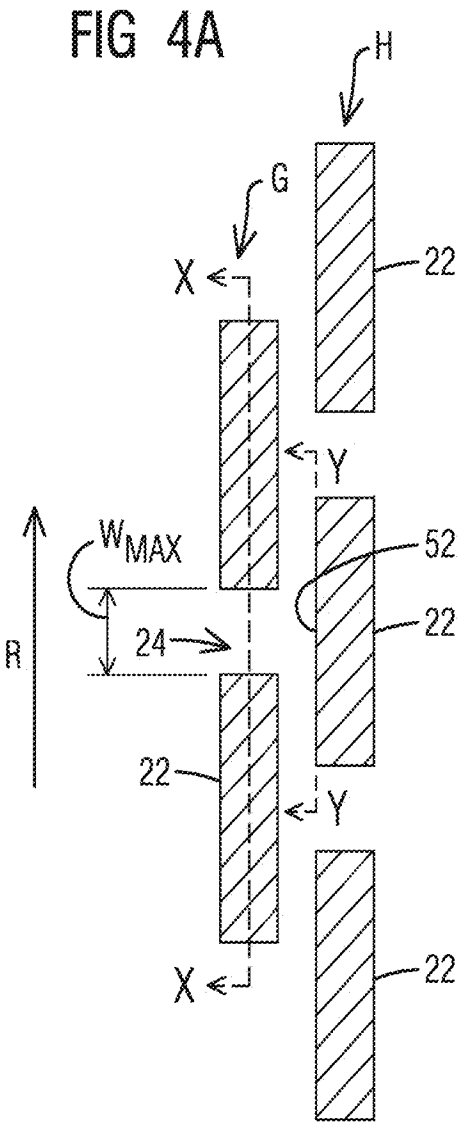
FIG. 4A illustrates an enlarged schematic view of a pair of adjacent rows of features looking in a direction from a pressure side to a suction side of an airfoil as per a second configuration in accordance with an example embodiment of the present invention.
Figure 4B:
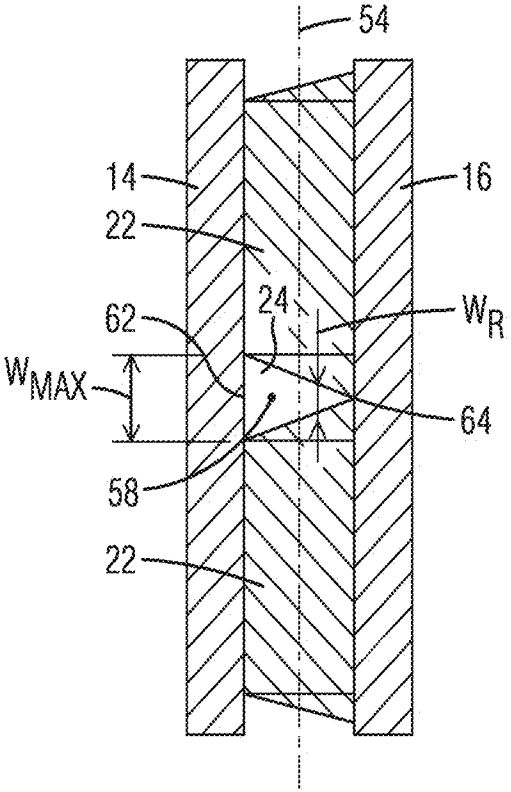
FIG. 4B illustrates a schematic sectional view along the section X-X of FIG. 4 A looking forward-to-aft, illustrating a flow cross-section of a coolant passage according to said example embodiment.
Figure 4C:
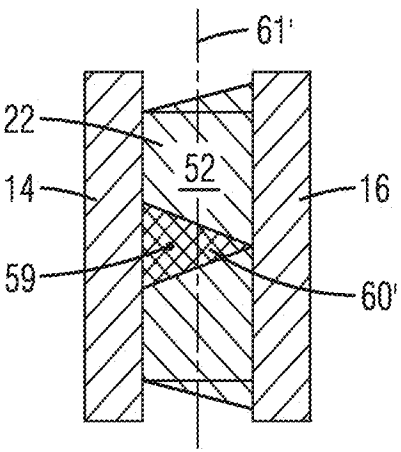
FIG. 4C illustrates a schematic sectional view along the section Y-Y of FIG. 4 A looking forward-to-aft, illustrating an impingement region according to said example embodiment.

FIGS. 4A-C illustrate a second configuration incorporating aspects of the present invention. Referring to FIG. 4A, the features 22 of adjacent rows are staggered in the radial direction R such that coolant ejected from a coolant passage 24 in a particular row, e.g., row G, impinges on a forward facing impingement surface 52 of a feature 22 in a chordally adjacent row, i.e., row H. In this example, the radial staggering is such that the coolant passage 24 of the upstream row G is aligned with a central portion of the feature 22 of the immediately downstream row H upon which the coolant is impinged. As shown particularly in FIGS. 4B-C, the present inventors have modified the shape of the features 22 such that the coolant passage 24 between radially adjacent features 22 is geometrically configured to bias coolant flow toward the pressure side 14 in relation to the suction side 16, while maintaining a high overall heat transfer and pressure drop as provided by the first configuration. To achieve the above effect, each coolant passage 24 may have a flow cross-section perpendicular to the chordal direction 30 having an asymmetrical geometry with reference to the radial centerline 54 between the pressure side 14 and the suction side 16, as shown in FIG. 4B. In particular, the flow cross-section may be shaped such that a center of mass 58 of flow through the flow cross-section is offset from the radial centerline 54 toward the pressure side 14.

Referring to FIG. 4B, in contrast to the first configuration, the coolant passage 24 of the second configuration has a triangular shaped flow cross-section extending from the pressure side 14 to the suction side 16, with a base 62 positioned at the pressure side 14 and an apex 64 positioned at the suction side 16. As shown, the coolant passage 24 has a radial width WR that converges from the pressure side 14 to the suction side 16 such that the coolant mass flow distribution is offset toward the pressure side. This ensures a higher local velocity of the coolant along the pressure side 14 than the suction side 16, in turn, effecting a higher convective heat transfer at the pressure side 14 in relation to the suction side 16.

In addition to the benefit of biasing convective heat transfer toward one side, the illustrated embodiments may also have an impact on the impingement portion of the heat transfer near the trailing edge. This effect may be illustrated by a comparison of the illustrated embodiment shown in FIG. 4A-C with the configuration shown in FIG. 3A-C. Referring in particular to FIG. 3C, in the first configuration, since the flow cross-section through the coolant passage 24 is symmetrical about the centerline 54, a resultant distribution of coolant jet 60 on the impingement surface 52 is also symmetrical whereby an adiabatic line 61 is centered between the pressure side 14 and the suction side 16. An adiabatic line may be defined as an imaginary line on the impingement surface 52 of the feature 22 at which there is a change in the direction of heat transfer. In other words, if the feature 22 is considered to be made of two fins extending respectively from the pressure side 14 and the suction side 16, the adiabatic line 61 may be considered as the common tip of the two fins. Since the conduction path lengths on either side of the adiabatic line 61 is equal in this case, the rate of heat transfer by conduction is equal on opposite sides of the adiabatic line 61, resulting in roughly the same amount of heat removed from the pressure and suction sides 14, 16 by impingement cooling. On the other hand, in the illustrated embodiment of the present invention, since the flow through the coolant passage 24 has a center of mass 58 offset toward the pressure side 14 (see FIG. 4B), the resultant coolant jet 60' on the impingement surface 52 also has a center of mass 59 that is correspondingly offset toward the pressure side 14 (see FIG. 4C), whereby there is a significant impingement reduction at the suction side 16 due to flow being pushed toward the pressure side 14. This results in an adiabatic line 61' that is offset toward the pressure side 14, making the conduction path length from the adiabatic line 61' to the pressure side 14 shorter than the conduction path length from the adiabatic line 6 Γ to the suction side 16. A higher rate of heat transfer by conduction through the feature 22 is thereby achieved at the pressure side 14 than the suction side 16. In other words, a greater amount of impingement cooling is effected at the pressure side 14 than the suction side 16.

In the embodiment shown in FIGS. 4A-C, the shapes of the features 22 are modified with respect to the configuration shown in FIGS. 3A-C, to provide a flow cross-section that creates a biased flow toward the pressure side 14. In the embodiment of FIGS. 4A-C, the maximum radial width WMax of the coolant passage 24 may be greater than the constant radial width WR of the coolant passage 24 in the configuration of FIGS. 3A-C. To prevent an increase in coolant flow rate, it may be desirable that the coolant passage of FIGS. 4A-C has an overall flow cross-sectional area not greater than that of the configuration of FIGS. 3A-C. Furthermore, the array may be geometrically configured such that the coolant jet ejected from the coolant passage 24 entirely impinges upon the impingement surface 52 of the feature 22 in the adjacent row. This is particularly enabled by a high aspect ratio of the features 22 as described previously. In the illustrated embodiment, the length LR of each feature 22 in the radial direction R is greater than the maximum width WMax of each coolant passage 24 in the radial direction R, to prevent the coolant flow from bypassing the features 22 by radially skipping over the features 22, which would actually lead to a reduction in the overall heat transfer.

Figure 5A:
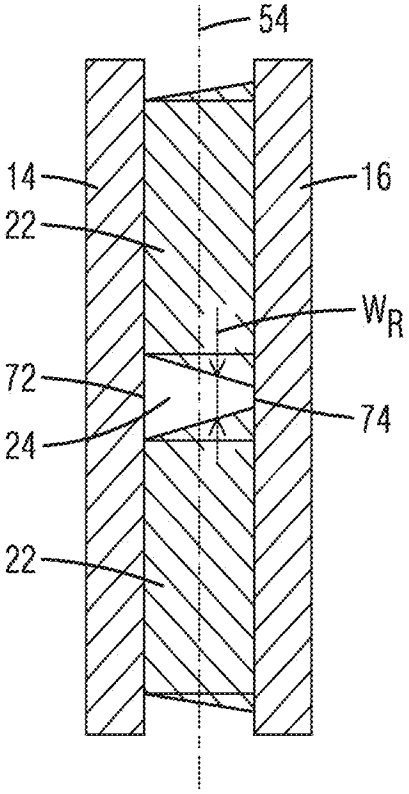
FIGS. 5A-C schematically illustrate various exemplary coolant passage flow cross-section shapes in axial views looking forward-to-aft.
Figure 5B:
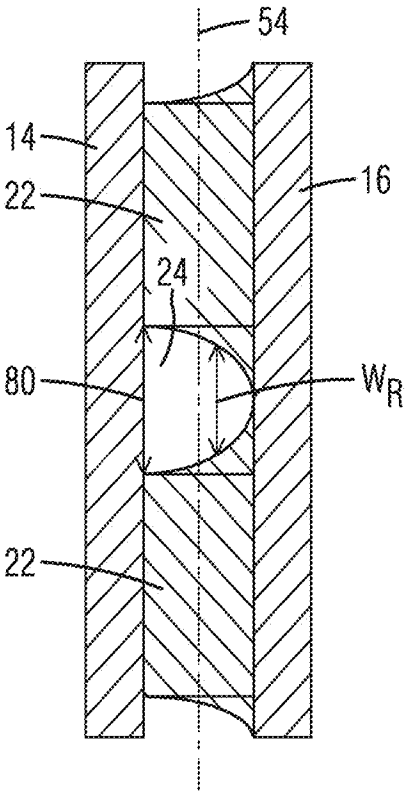
Figure 5C:
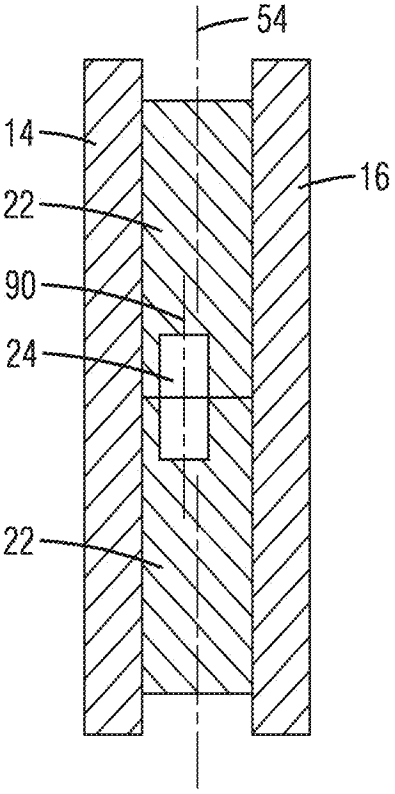

It should be noted that various other geometries may be employed based on the principle of biasing of coolant flow toward one side of the airfoil outer wall 12 in relation to the other. For example, in a non-limiting embodiment shown in FIG. 5A, the coolant passage 24 may have a trapezoidal flow cross-section having first and second parallel sides 72, 74, such that the first side 72 is located at the pressure side 14 and the second side 74 is located at the suction side 16. In another non-limiting embodiment shown in FIG. 5B, the coolant passage 24 may have a semi-circular flow cross-section having a diameter 80 positioned at the pressure side 14 and extending all the way up to the suction side 16. In both cases (FIGS. 5A-B), the flow cross-section has a converging radial width WR from the pressure side 14 to the suction side 16. In alternate embodiments, the flow cross-section of the coolant passage may include a geometric shape symmetrical about an axis parallel to the radial direction, the axis of symmetry being offset from the centerline toward the pressure side. For example, in a non-limiting embodiment shown in FIG. 5C, the coolant passage 24 may have a rectangular flow cross-section elongated in the radial direction R with a longitudinal axis of symmetry 90 parallel to the radial direction R, which is offset from the radial centerline 54 toward the pressure side 14. In further embodiments (not shown), it may be possible to bias the coolant flow toward the pressure side in the radial direction as well, by shaping the features. Furthermore, heavily contoured shapes could be employed to increase local impingement effectiveness through area enhancement, while globally pushing flow toward the pressure side.

By biasing the coolant flow toward the hotter side, which in this case is the pressure side, several benefits may be realized. For example, the metal temperature of the hotter side can be brought down more than on the cooler side leading to a more uniform temperature distribution, which is desirable. Additionally, since less heat is removed from the side that requires less cooling in order to meet life, which in this case is the suction side, the fluid heat up through the trailing edge array may be reduced, which would allow better cooling to be effected toward the end of the array. Managing coolant heat up is especially desirable in low coolant flow designs, such as the illustrated trailing edge array.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. An airfoil for a turbine engine, comprising:

an outer wall formed by a pressure side and a suction side extending span-wise along a radial direction (R) and joined at a leading edge and at a trailing edge, an array of features positioned in an interior portion of the airfoil, each feature extending from the pressure side to the suction side, the array comprising multiple radial rows (A-N) of said features with the features in each row (A-N) being interspaced radially to define coolant passages therebetween, the radial rows (A-N) being spaced along a forward-to-aft direction toward the trailing edge, wherein the coolant passages of the array are fluidically interconnected to lead a pressurized coolant toward the trailing edge via a serial impingement on to said rows (A-N) of features, wherein the radially interspaced features in each row (A-N) defining the coolant passages are geometrically configured such that the cooling passages bias a coolant flow therethrough toward a first side in relation to a second side of the outer wall, to effect a greater cooling of the first side than the second side, and wherein each feature is elongated in the radial direction (R) and the first side is the pressure side and the second side is the suction side, the radially interspaced features in each row (A-N) defining the coolant passages are configured such that each coolant passage has a flow cross-section having an asymmetrical geometry with reference to a centerline between the first side and the second side and the flow cross-section has a converging radial width (WR) to an apex in a direction from the first side to the second side.

2. The airfoil according to claim 1, wherein the flow cross-section is shaped such that a center of mass of flow through the flow cross-section is offset from said centerline toward the first side.

3. The airfoil according to claim 1, wherein the flow cross-section includes a geometric shape with an axis of symmetry parallel to the radial direction (R), the axis of symmetry being offset from said centerline toward the first side.

4. The airfoil according to claim 1, wherein the radially interspaced features in each row (A-N) defining the coolant passages are configured such that each coolant passage extends from the first side to the second side.

5. The airfoil according to claim 1, wherein the radially interspaced features in each row (A-N) defining the coolant passages are configured such that each coolant passage has a flow axis parallel to the forward-to-aft direction.

6. The airfoil according to claim 1, wherein the array of features is configured such that coolant ejected from a corresponding one of the coolant passages in a particular row (G) impinges on a respective impingement surface of a feature in an adjacent row (H), and wherein the radially interspaced features defining the corresponding one of the coolant passages are configured such that the corresponding one of the coolant passages has a flow-cross-section which is geometrically configured such that a distribution of coolant jet impinging upon the impingement surface is higher toward the first side than the second side.

7. The airfoil according to claim 1, wherein a length (LR) of each feature in the radial direction (R) is greater than a maximum width (WMax) of each coolant passage in the radial direction (R).

8. The airfoil according to claim 1, wherein each feature has a length (LR) in the radial direction (R) which is greater than a stream-wise pitch (Py) of the array along in the forward-to-aft direction.

9. An airfoil for a turbine engine, comprising:

an outer wall delimiting an airfoil interior and being formed by a pressure side and a suction side extending span-wise along a radial direction (R) and joined at a leading edge and at a trailing edge, wherein a chordal direction is defined extending from the leading edge to the trailing edge, an array of features positioned in the airfoil interior, each feature extending from the pressure side to the suction side, the array comprising multiple radial rows (A-N) of said features with the features in each row being interspaced radially to define coolant passages therebetween, the radial rows (A-N) being spaced along the chordal direction, wherein the radially interspaced features in each row (A-N) defining the coolant passages of the array are configured such that the coolant passages are fluidically interconnected to lead a pressurized coolant from a coolant cavity chordally upstream of said array toward a plurality of exhaust openings at the trailing edge, wherein the radially interspaced features in each row (A-N) defining the coolant passages are geometrically configured such that coolant ejected through the coolant passages has a higher local velocity along the pressure side than along the suction side to effect a greater convective cooling at the pressure side than the suction side, wherein the radially interspaced features in each row (A-N) defining the coolant passages are configured such that each coolant passage has a flow cross-section perpendicular to the chordal direction having a shape which is asymmetrical with reference to a radial centerline between the pressure side and the suction side, and wherein the radially interspaced features in each row (A-N) defining the coolant passages are configured such that the flow cross-section has a converging radial width (WR) to an apex from the pressure side to the suction side.

10. An airfoil for a turbine engine, comprising:

an outer wall delimiting an airfoil interior and being formed by a pressure side and a suction side extending span-wise along a radial direction (R) and joined at a leading edge and at a trailing edge, wherein a chordal direction is defined extending from the leading edge to the trailing edge, an array of features positioned in the airfoil interior, each feature extending from the pressure side to the suction side, the array comprising multiple radial rows (A-N) of said features with the features in each row (A-N) being interspaced radially to define coolant passages therebetween, the radial rows (A-N) being spaced along the chordal direction, wherein the coolant passages of the array are fluidically interconnected to lead a pressurized coolant from a coolant cavity chordally upstream of said array toward a plurality of exhaust openings at the trailing edge, via a series of impingements on to said rows (A-N) of features, and wherein the features of chordally adjacent rows (A-N) are staggered in the radial direction (R) and configured such that coolant ejected from a coolant passage in a particular row (G) impinges on an impingement surface of a feature in a chordally adjacent row (H), and wherein the radially interspaced features in each row (A-N) defining the coolant passages are geometrically configured such that each coolant passage has a flow cross-section geometrically configured such that a distribution of coolant jet impinging upon the impingement surface is higher toward the pressure side than the suction side to effect a greater impingement cooling at the pressure side than the suction side, wherein the features of the array are geometrically configured such that the coolant jet ejected from said coolant passage entirely impinges upon the impingement surface of said feature in the adjacent row (H) wherein the radially interspaced features in each row (A-N) are configured such that the flow cross-section has a converging radial width (WR) to an apex from the pressure side to the suction side.

11. The airfoil according to claim 10, wherein the features of chordally adjacent rows (A-N) are configured such that the flow cross-section of the coolant passage is asymmetrical with respect to a radial centerline between the pressure side and the suction side, and wherein a center of mass of flow through the flow cross-section is offset from said radial centerline toward the pressure side.

12. The airfoil according to claim 10, wherein a length (LR) of each feature in the radial direction (R) is greater than a maximum width (WMax) of each coolant passage in the radial direction (R).

* * * * *